United States Patent [19]

Graham

[11] 4,016,609

[45] Apr. 12, 1977

[54] FLUSH OPERATED SANITARY FACILITY

[76] Inventor: J. Thomas Graham, Rte. 6, Box 6343, Bainbridge Island, Wash. 98110

[22] Filed: May 14, 1975

[21] Appl. No.: 577,213

[52] U.S. Cl. ..... 4/10; 4/76; 4/79; 4/92

[51] Int. Cl.[2] ..... E03D 1/00; E03D 3/00; E03D 5/00

[58] Field of Search ..... 4/1–3, 6–7, 4/166, 167, 169, DIG. 2, 10, 69 A, 76, 79, 92

[56] References Cited

UNITED STATES PATENTS

| | | | |
|---|---|---|---|
| 1,808,294 | 6/1931 | Crane | 4/3 |
| 1,868,760 | 7/1932 | Norberg | 4/3 |
| 1,935,779 | 11/1933 | Kemach | 4/3 |
| 3,015,827 | 1/1962 | Inata | 4/3 X |
| 3,124,808 | 3/1964 | Tiller | 4/3 |
| 3,458,871 | 8/1969 | Di Valcervo | 4/3 |
| 3,582,995 | 6/1971 | Enenstein | 4/3 |
| 3,696,448 | 10/1972 | Carfora | 4/3 |
| 3,789,436 | 2/1974 | Maier-Garber | 4/6 X |
| 3,881,200 | 5/1975 | Maier-Garber | 4/166 |

*Primary Examiner*—Henry K. Artis
*Attorney, Agent, or Firm*—Christopher Duffy

[57] ABSTRACT

There are means in the sanitary facility defining a receiving bowl for liquid and/or solid excrement, and the bowl has a discharge valve in the bottom portion thereof. Also, there are means for controlling flow through the valve, including a pivotally mounted water receptacle which is operative to open the valve to flow when the receptacle is relatively inclined about its pivotal axis in a first position, and to close the valve to flow when the receptacle is relatively inclined about its pivotal axis in a second position relatively angularly spaced from the first position. Additionally, there are means for supplying water to the bowl to form a pool of carrier liquid therein when the valve is closed; a control valve which is adapted to be interconnected to a source of pressurized water; and control means which are responsive to the level of water in the bowl to close and open the control valve to flow as the water level rises and falls, respectively. Hand or foot operated means are provided for yieldably biasing the receptacle into the first relatively inclined position thereof, to open the discharge valve in the bowl to flow, and there are means providing a connection between the control valve and the receptacle whereby the receptacle is supplied with water when the control valve is open to flow. Furthermore, the receptacle is eccentrically mounted about its pivotal axis to pivot between the first and second positions thereof against the bias thereon, when the water accumulates to a predetermined level in the receptacle, thus closing the bowl discharge valve to flow; and there are means on the receptacle for discharging the water from the same when the receptacle assumes the second position thereof, to restore the receptacle to a neutral condition when the bowl discharge valve is closed.

9 Claims, 3 Drawing Figures

FLUSH OPERATED SANITARY FACILITY

SUMMARY OF THE INVENTION

This invention relates to a sanitary facility and in particular to one which is flush operated.

According to the invention, there are means in the sanitary facility defining a receiving bowl for liquid and/or solid excrement, and the bowl has a discharge valve in the bottom portion thereof. Also, there are means for conrolling flow through the valve, including a pivotally mounted water receptacle which is operative to open the valve to flow when the receptacle is relatively inclined about its pivotal axis in a first position, and to close the valve to flow when the receptacle is relatively inclined about its pivotal axis in a second position relatively angularly spaced from the first position. Additionally, there are means for supplying water to the bowl to form a pool of carrier liquid therein when the valve is closed; a control valve which is adapted to be interconnected to a source of pressurized water; and control means which are responsive to the level of water in the bowl to close and open the control valve to flow as the water level rises and falls, respectively. Hand or foot operated means are provided for yieldably biasing the receptacle into the first relatively inclined position thereof, to open the discharge valve in the bowl to flow, and there are means providing a connection between the control valve and the receptacle whereby the receptacle is supplied with water when the control valve is open to flow. Furthermore, the receptacle is eccentrically mounted about its pivotal axis to pivot between the first and second positions thereof against the bias thereon, when the water accumulates to a predetermined level in the receptacle, thus closing the bowl discharge valve to flow; and there are means on the receptacle for discharging the water from the same when the receptacle assumes the second position thereof, to restore the receptacle to a neutral condition when the bowl discharge valve is closed.

Ordinarily the bowl is adapted to be sat upon.

In presently preferred embodiments of the invention, the control valve is float operated and the float is disposed on the pool of water in the bowl. The bowl has a top opening recess therein, there is a baffle on the bowl which depends in the recess so as to form a relatively down opening chamber behind the baffle, and the float is disposed on the pool in the chamber. Additionally, the receptacle takes the form of a closed container having a water receiving chamber therein and inlet and outlet openings to and from the same, the inlet opening to which is connected with the control valve and the outlet opening from which opens into the chamber of the bowl.

In one of these embodiments, the container takes the form of an elongated tube which is eccentrically pivotally mounted in the chamber of the bowl.

Preferably, the means for controlling flow through the bowl discharge valve include a valve closure member which is relatively reciprocably mounted adjacent the discharge valve to control flow therethrough, and a connection between the receptacle and the closure member which is operative to reciprocate the closure member into the valve opening position thereof when the receptacle assumes the first position thereof, and to release the closure member for reciprocation into the valve closure position thereof when the receptacle assumes the second position thereof.

The valve closure member is preferably pivotally mounted on the bowl. Also, the facility normally further comprises means for adjusting the rate at which water is supplied to the receptacle.

BRIEF DESCRIPTION OF THE DRAWINGS

These features will be better understood by reference to the accompanying drawings which illustrate a presently preferred embodiment of the invention.

In the drawings.

DESCRIPTION OF THE PREFERRED EMBODIMENT

Figure 1:
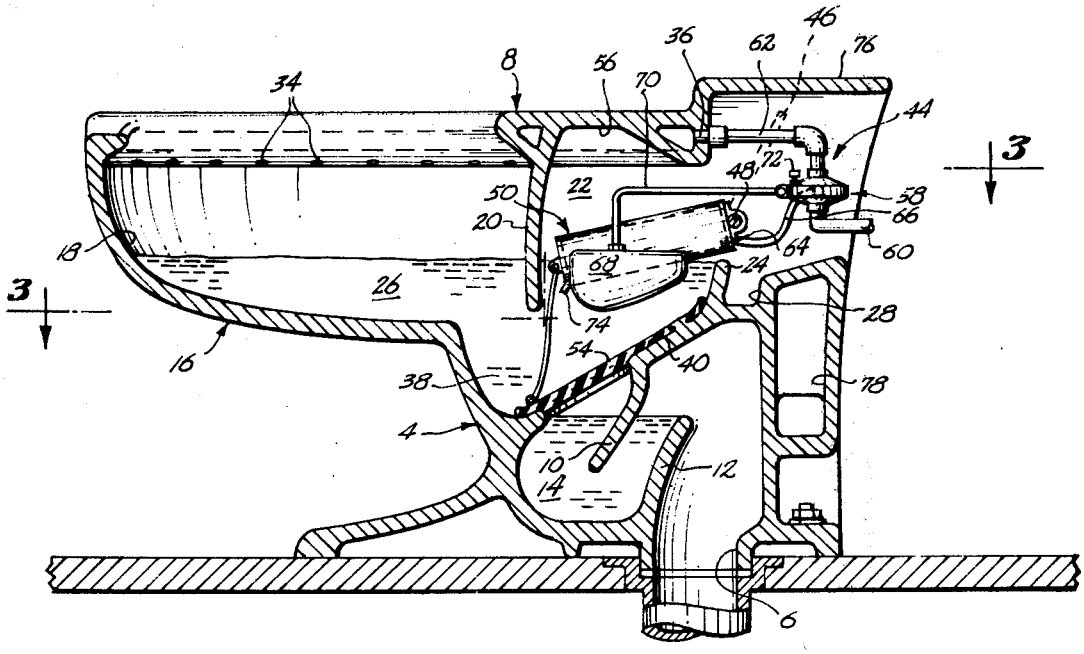
FIG. 1 is a part cross sectional view of a sanitary facility when the bowl has a pool of water as a carrier liquid therein.

Referring to the drawings, it will be seen that the sanitary facility comprises a floor mounted, molded ceramic water closet 2 which has a supporting base 4 with a discharge outlet 6 in the bottom thereof, and an intercommunicating seat portion 8 superposed on the base. The interior of the base defines a pair of reversedly disposed baffles 10 and 12, which form a trap 14 for the discharge outlet; and the seat portion 8 cantilevers forwardly of the trap and defines a receiving bowl 16 for liquid and/or solid excrement thereabove. The bowl has a top opening recess 18 therein, and defines a baffle 20 which depends in the recess so as to form a relatively down opening chamber 22 therebehind. The chamber 22 opens to the rear of the water closet, but has an upstanding lip 24 in the bottom thereof which is disposed opposite the baffle 20 so that a pool of water 26 can be formed in the recess to each side of the baffle. The lip 24 also defines the forward end wall of an overflow trough 28 which discharges from the closet at a point which is not seen in FIGS. 1-3.

The major portion of the water for the pool is fed into the recess 18 through a manifold 30 that extends about the peripheral rim 32 of the bowl, and opens into the recess through a series of orifices 34 in the rim. The manifold is supplied through an opening 36 at the rear of the rim, and as the pool of water collects in the recess, it also covers a throat 38 which is contoured into the bottom portion of the bowl. The throat 38 has a bottom wall 40 which inclines to the horizontal under the baffle and is equipped with a valve opening 42 for discharging the pool of water into the trap 14.

As indicated, the sanitary facility is flush operated. The flush operation is controlled by a mechanism which is indicated generally at 44 and includes a pair of foot pedals 46 that are fixed to the outside ends of a shaft 48 which is pivotally mounted across the chamber above the pool. The shaft has an elongated tubular water receptacle 50 thereon, which is secured at one end to the shaft and cantilevered forwardly from it so as to be eccentrically mounted with respect to the axis of the shaft. The receptacle is equipped with a flexible cord 52 on the forward end thereof, which is attached to a neoprene flap 54 that forms a closure member for the opening 42. The flap is seated in the throat 14 over the opening, and is adapted and secured to the bottom wall 40 of the throat so that it can be reciprocated with respect to the opening by flexing it between the valve closure position of FIG. 1 and the valve opening position of FIG. 2. Raising the forward end of the water receptacle by depressing one or both of the foot pedals 46, operates to flex the flap into the position of FIG. 2 as seen. However, when the receptacle 50 is tipped downward and returned to the position of FIG. 1 against the weight of the foot pedals, as shall be explained, the cord 52 slackens and allows the water in the recess to depress the flap and return the flap to the valve closure position of FIG. 1. Any water added behind the baffle 20 is particularly effective in this regard, as shall be explained.

Figure 2:
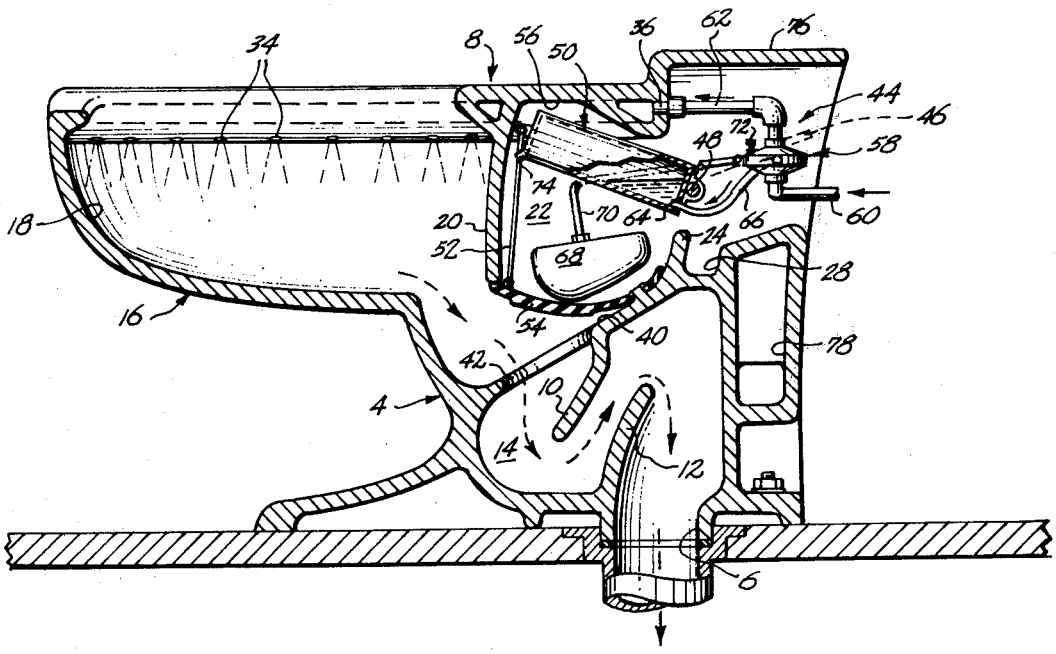
FIG. 2 is another cross sectional view of the facility after the pool of water has been flushed.
Figure 3:
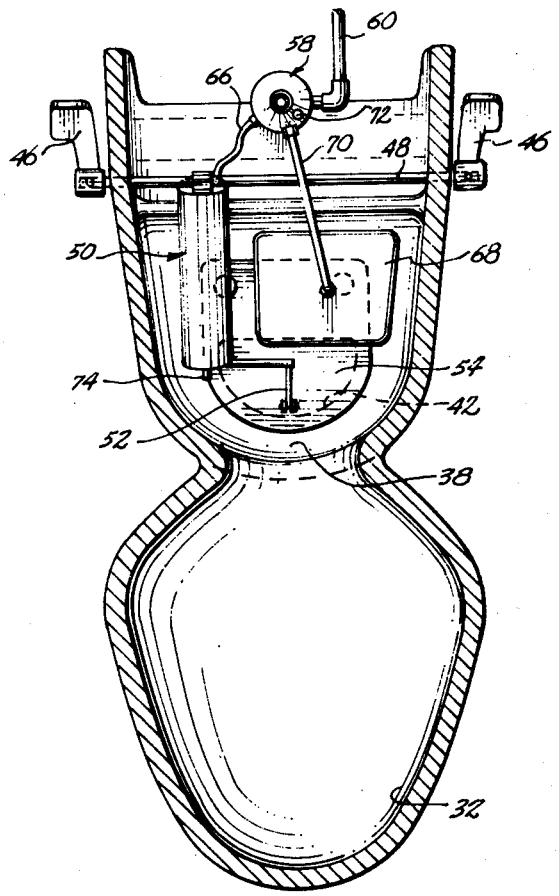
FIG. 3 is still another cross sectional view of the facility along the line 3—3 of FIG. 1.

The rim of the seat portion 6 is normally adapted to be sat upon, and to provide an alcove 56 in the ceiling of the chamber for accomodating the forward end of the water receptacle in the valve opening position of FIG. 2 as seen.

The mechanism 44 also conprises a diaphragm operated control valve 58 which is mounted in the back of the chamber 22 and adapted to be interconnected to a source of pressurized water at 60. The control valve is interconnected with the opening 36 to the manifold through a pipe connection seen at 62, and is also interconnected with an inlet opening 64 in the rear end of the water receptacle, by means of a flexible tube 66 interposed therebetween. The control valve is operated by a float 68 which is disposed on the pool of water 26 in the chamber, and interconnected with the control valve by means of a bent rod 70.

A knob 72 is provided on the valve 58 for adjusting the rate at which water is supplied to the receptacle through the valve.

The water receptacle also has an outlet opening 74 in the forward end thereof, for draining the receptacle, as shall be explained.

In operation, the float means 68 are responsive to the level of water 26 in the bowl 16 to close and open the control valve 58 to flow as the water level rises and falls, respectively; and the pedals 46 on the shaft 48 are operative to yieldably bias the receptacle into the relatively inclined position of FIG. 2, to open the discharge valve 42 in the bowl to flow as indicated. Thus, as soon as the water level drops, the control valve 58 is opened and begins supplying the receptacle with water through the connection 66. When the water accumulates to a predetermined level in the receptacle, the receptacle pivots between the position of FIG. 2 and the position of FIG. 1, due to its eccentric mounting on the shaft, thus closing the bowl discharge valve 42 to flow. With the valve closed, water accumulates once again in the bowl and eventually the float means 68 closes the control valve 58. Meanwhile, the water in the receptacle is discharged from the same through the outlet opening 74, thus restoring the receptacle to a neutral condition when the bowl discharge valve is closed.

The facility may include other features such as a laboratory above the rear deck 76 of the water closet. However, given these other features, the deck may be omitted, and it is shown in the Figures merely for the sake of completeness.

Additionally, the laboratory may be discharged through the rear wall 78 of the water closet, which has a hollow compartmented construction as seen.

I claim:

1. In a sanitary facility, means defining a receiving bowl for liquid and/or solid excrement, having a discharge valve in the bottom portion thereof, means for controlling flow through the valve, including a pivotally mounted water receptacle which is operative to open the valve to flow when said receptacle is relatively inclined about its pivotal axis in a first position, and to close the valve to flow when said receptacle is relatively inclined about its pivotal axis in a second position relatively angularly spaced from said first position, means for supplying water to the bowl to form a pool of carrier liquid therein when the valve is closed, a control valve which is adapted to be interconnected to a source of pressurized water, control means which are responsive to the level of water in the bowl to close and open the control valve to flow as the water level rises and falls, respectively, hand or foot operated means for yieldably biasing the receptacle into the first relatively inclined position thereof, to open the discharge valve in the bowl to flow, and means providing a connection between the control valve and the receptacle whereby the receptacle is supplied with water when the control valve is open to flow, said receptacle being eccentrically mounted about its pivotal axis to pivot between the first and second positions thereof against the bias thereon, when the water accumulates to a predetermined level in the receptacle, thus closing the bowl discharge valve to flow, and there being means on the receptacle for discharging the water from the same when the receptacle assumes the second position thereof, to restore the receptacle to a neutral condition when the bowl discharge valve is closed.

2. The sanitary facility according to claim 1 wherein the bowl is adapted to be sat upon.

3. The sanitary facility according to claim 1 wherein the control valve is float operated and the float is disposed on the pool of water in the bowl.

4. The sanitary facility according to claim 3 wherein the bowl has a top-opening recess therein, there is a baffle on the bowl which depends in the recess so as to form a relatively down-opening chamber behind the baffle, and the float is disposed on the pool in the chamber.

5. The sanitary facility according to claim 4 wherein the receptacle takes the form of a closed container having a water receiving chamber therein and inlet and outlet openings to and from the same, the inlet opening to which is connected with the control valve and the outlet opening from which opens into the chamber of the bowl.

6. The sanitary facility according to claim 5 wherein the container takes the form of an elongated tube which is eccentrically pivotally mounted in the chamber of the bowl.

7. The sanitary facility according to claim 1 wherein the means for controlling flow through the bowl discharge valve include a valve closure member which is relatively reciprocably mounted adjacent the discharge valve to control flow therethrough, and a connection between the receptacle and the closure member which is operative to reciprocate the closure member into the valve-opening position thereof when said receptacle assumes the first position thereof, and to release the closure member for reciprocation into the valve closure position thereof when said receptacle assumes the second position thereof.

8. The sanitary facility according to claim 7 wherein the valve closure member is pivotally mounted on the bowl.

9. The sanitary facility according to claim 1 further comprising means for adjusting the rate at which water is supplied to the receptacle.

* * * * *